US010556323B2

(12) United States Patent
Alkhas et al.

(10) Patent No.: US 10,556,323 B2
(45) Date of Patent: Feb. 11, 2020

(54) NONWOVEN ABRASIVE ARTICLE AND METHOD OF MAKING THE SAME

(71) Applicant: 3M INNOVATIVE PROPERTIES COMPANY, St. Paul, MN (US)

(72) Inventors: Robinette S. Alkhas, Winnetka, CA (US); Ronald D. Apple, Apple Valley, MN (US); Louis S. Moren, Oakdale, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 15/555,910

(22) PCT Filed: Mar. 30, 2016

(86) PCT No.: PCT/US2016/025024

§ 371 (c)(1),
(2) Date: Sep. 5, 2017

(87) PCT Pub. No.: WO2016/167967

PCT Pub. Date: Oct. 20, 2016

(65) Prior Publication Data

US 2018/0036866 A1 Feb. 8, 2018

Related U.S. Application Data

(60) Provisional application No. 62/196,675, filed on Jul. 24, 2015, provisional application No. 62/147,369, filed on Apr. 14, 2015.

(51) Int. Cl.
*B24D 11/00* (2006.01)
*B24D 3/28* (2006.01)
(Continued)

(52) U.S. Cl.
CPC ..... *B24D 11/005* (2013.01); *B24D 3/00* (2013.01); *B24D 3/002* (2013.01); *B24D 3/28* (2013.01);
(Continued)

(58) Field of Classification Search
CPC . B24D 3/00; B24D 3/002; B24D 3/14; B24D 3/20; B24D 3/28; B24D 11/005; B24D 13/00; B24D 18/0072; C09K 3/14
(Continued)

(56) References Cited

U.S. PATENT DOCUMENTS 1,910,444 A 5/1933 Nicholson
2,307,698 A 1/1943 Melton
(Continued)

FOREIGN PATENT DOCUMENTS

CN 101557905 A 10/2009
JP 2007-516085 6/2007
(Continued)

OTHER PUBLICATIONS

International Search Report for PCT International Application No. PCT/US2016/025024, dated Jul. 22, 2016, 5 pages

*Primary Examiner* — Eileen P Morgan
(74) *Attorney, Agent, or Firm* — Katherine M. Scholz; Bradford B. Wright

(57) ABSTRACT

A nonwoven abrasive article includes a lofty open nonwoven fiber web comprising entangled fibers; and abrasive platelets secured to the entangled fibers by at least one binder material. A majority of the abrasive platelets are respectively bonded in an edge-wise manner to at least one of the entangled fibers. Methods of making the nonwoven abrasive article and converted forms, including a convolute abrasive wheel, are also disclosed.

7 Claims, 7 Drawing Sheets

(51) Int. Cl.
*B24D 3/00* (2006.01)
*B24D 13/00* (2006.01)
*B24D 18/00* (2006.01)

(52) U.S. Cl.
CPC ..... *B24D 13/00* (2013.01); *B24D 18/0072* (2013.01)

(58) Field of Classification Search
USPC ..... 451/532
See application file for complete search history.

(56) References Cited

U.S. PATENT DOCUMENTS 2,473,528 A 6/1949 Hoover
2,958,593 A * 11/1960 Hoover ..... A47L 13/04 451/532
3,041,156 A 6/1962 Rowse
4,314,827 A 2/1982 Leitheiser
4,623,364 A 11/1986 Cottringer
4,652,275 A 3/1987 Bloecher
4,744,802 A 5/1988 Schwabel
4,770,671 A 9/1988 Monroe
4,799,939 A 1/1989 Bloecher
4,881,951 A 11/1989 Wood
4,997,461 A 3/1991 Markhoff-Matheny
5,009,675 A 4/1991 Kunz
5,011,508 A 4/1991 Wald
5,042,991 A 8/1991 Kunz
5,085,671 A 2/1992 Martin
5,152,917 A 10/1992 Pieper
5,201,916 A 4/1993 Berg
5,213,591 A 5/1993 Celikkaya
5,282,900 A 2/1994 McDonell
5,346,516 A * 9/1994 Alkhas ..... A47L 13/06 51/293
5,352,254 A 10/1994 Celikkaya
5,366,523 A 11/1994 Rowenhorst
5,435,816 A 7/1995 Spurgeon
5,458,962 A 10/1995 Birch
5,591,239 A 1/1997 Larson
RE35,570 E 7/1997 Rowenhorst
5,672,097 A 9/1997 Hoopman
5,685,935 A 11/1997 Hoover
5,863,305 A * 1/1999 Beardsley ..... B24D 3/28 51/294
5,919,549 A * 7/1999 Van ..... B24D 3/004 428/141
5,928,394 A * 7/1999 Stoetzel ..... B24D 3/002 51/295
5,946,991 A 9/1999 Hoopman
5,975,987 A 11/1999 Hoopman
5,984,988 A 11/1999 Berg
6,017,831 A 1/2000 Beardsley
6,129,540 A 10/2000 Hoopman
6,352,567 B1 3/2002 Windisch
7,393,371 B2 7/2008 O'Gary
8,034,137 B2 10/2011 Erickson
8,142,531 B2 3/2012 Adefris
8,142,532 B2 3/2012 Erickson
8,142,891 B2 3/2012 Culler
8,869,740 B2 10/2014 Moren
9,079,294 B2 * 7/2015 Holmes ..... B24D 3/02
9,707,529 B2 * 7/2017 Josseaux ..... B01J 2/26
9,803,119 B2 * 10/2017 Breder ..... C09K 3/1409
2006/0041065 A1 2/2006 Barber, Jr.
2008/0233850 A1 * 9/2008 Woo ..... B24B 7/00 451/526
2009/0165394 A1 * 7/2009 Culler ..... B01J 2/22 51/296
2009/0169816 A1 7/2009 Erickson
2012/0227333 A1 9/2012 Adefris
2013/0040537 A1 2/2013 Schwabel
2013/0125477 A1 * 5/2013 Adefris ..... C09K 3/1418 51/309
2015/0089881 A1 * 4/2015 Stevenson ..... C09K 3/1409 51/309
2015/0291865 A1 * 10/2015 Breder ..... C09K 3/1409 51/309
2016/0354898 A1 * 12/2016 Nienaber ..... B24D 3/002
2017/0312887 A1 * 11/2017 Keipert ..... B24D 11/001

FOREIGN PATENT DOCUMENTS

JP 2013-533128 8/2013
WO WO 97-42003 11/1997
WO WO 98-23411 6/1998
WO WO 2004/097095 11/2004
WO WO-2004097095 A1 * 11/2004 ..... A47L 13/16
WO WO 2007/139097 6/2007
WO WO 2012-006017 1/2012
WO WO 2012/018903 2/2012
WO WO 2013-151745 10/2013
WO WO 2014-137972 9/2014
WO WO-2014137972 A1 * 9/2014 ..... B24D 3/14
WO WO 2014-161001 10/2014

* cited by examiner

1000μm

1000μm

NONWOVEN ABRASIVE ARTICLE AND METHOD OF MAKING THE SAME

TECHNICAL FIELD

The present disclosure broadly relates to nonwoven abrasive articles, and methods of their manufacture and use.

BACKGROUND

Nonwoven abrasive articles generally have a nonwoven web (e.g., a lofty open fibrous nonwoven web), abrasive particles, and a binder material (commonly termed a "binder") that bonds the fibers within the nonwoven web to each other and secures the abrasive particles to the nonwoven web. Examples of nonwoven abrasive articles include nonwoven abrasive hand pads and surface conditioning abrasive discs and belts such as those marketed by 3M Company of Saint Paul, Minn. under the trade designation SCOTCH-BRITE.

Nonwoven abrasive wheels are another type of nonwoven abrasive article. Examples of nonwoven abrasive wheels include convolute abrasive wheels (spirally wound nonwoven abrasive web around a core) and unitized abrasive wheels (one or more individual discs of nonwoven abrasive web formed into a stack). Nonwoven abrasive wheels are also available from 3M Company of Saint Paul, Minn. under the trade designation SCOTCH-BRITE.

In one manufacturing method, a nonwoven fiber web is coated with a binder precursor material. Next, abrasive particles are adhered to the binder precursor material, which is then cured to secure the abrasive particles to the fiber web.

Historically, lofty, open, non-woven abrasive articles have been made using a variety of coating techniques. For example, in the U.S. Pat. No. 2,958,593 (Hoover et al.), nonwoven abrasive articles were made by the spray application of a relatively dilute slurry comprising a solution of a binder, solvent, and abrasive particles. In another method, the abrasive particles may be applied by a drop coating method as described in PCT Internat. Publ. No. WO 2014/137972 Al (Kaur et al.).

U.S. Pat. No. 6,017,831 (Beardsley et al.) describes yet another a coating technique in which a uniformly dispersed cloud of fine abrasive particles is deposited (preferably by settling due to gravity) onto binder precursor-coated fibers. Use of electrostatic coating to orient abrasive particles and bond them to a lofty nonwoven material is described in U.S. Pat. No. 7,393,371 (O'Gary et al.).

SUMMARY

Notwithstanding the above disclosure, the present inventors unexpectedly found that under suitable conditions, abrasive platelets can be coated continuously along the fibers of the nonwoven fiber web such that they are disposed as a single layer (preferably closely-packed), with the abrasive particles extending perpendicularly in all directions around the fiber axis.

In a first aspect, the present disclosure provides a nonwoven abrasive article comprising:

a nonwoven abrasive article comprising:

a lofty open nonwoven fiber web comprising entangled fibers; and abrasive platelets secured to the entangled fibers by at least one binder material, and wherein a majority of the abrasive platelets are respectively bonded in an edge-wise manner to at least one of the entangled fibers, respectively.

Nonwoven abrasive articles according to the present disclosure may have the form of a hand pad, floor pad, surface conditioning pad, flap brush, disc, belt; or be converted into a unitized or convolute abrasive wheel.

In a second aspect, the present disclosure provides a method of making an abrasive article, comprising the steps:

i) providing a lofty open nonwoven fiber web comprising a plurality of entangled fibers;

ii) coating at least a portion of the lofty open nonwoven fiber web with a first curable binder precursor to provide a coated fiber web;

iii) electrostatically depositing a plurality of abrasive platelets on at least a portion of the first curable binder precursor; and iv) at least partially curing the first curable binder precursor, wherein a majority of the abrasive platelets are each bonded in an edge-wise manner to at least one of the entangled fibers, respectively.

In certain preferred embodiments, the method further comprises coating at least a portion of the first curable binder precursor and abrasive platelets with a second curable binder precursor, and at least partially curing the second binder precursor.

Unexpectedly and advantageously, nonwoven abrasive articles according to the present disclosure exhibit superior abrading performance as compared to conventional nonwoven abrasive articles typical of the abrasive art.

As used herein:

The term "bonded in an edge-wise manner" in reference to abrasive platelets bonded to fibers means that the abrasive platelets are bonded mainly by their peripheral edges to the fibers.

The term "closely-packed" in reference to abrasive platelets bonded to fibers means that a majority of the abrasive platelets (e.g., at least 50 percent, at least 60 percent, or even at least 75 percent) are spaced apart from adjacent abrasive platelets by a distance of less than the widths of the adjacent abrasive platelets.

The term "orthogonal" means forming an angle of from 75 degrees to 105 degrees (preferably 80 degrees to 100 degrees, and more preferably 85 degrees to 95 degrees).

The term "abrasive platelet" refers to an abrasive particle (whether randomly crushed, intentionally shaped and/or molded (e.g., a thin truncated triangular pyramid), or other) resembling a minute flattened body and/or flake that is characterized by a thickness that is substantially less than the width and length. Abrasive platelets generally have two opposed major sides defining the length and width of the abrasive platelet, and with the thickness disposed therebetween, joined along a peripheral edge that includes at least one line and/or at least one surface. For example, the thickness may be less than ½, ⅓, ¼, ⅕, ⅙, ⅐, ⅛, ⅑, or even less than 1/10 of the length and/or width.

The term "length" refers to the longest dimension of an object.

The term "width" refers to the longest dimension of an object that is perpendicular to the length.

The term "thickness" refers to the remaining dimension that is perpendicular to the length and the width.

Features and advantages of the present disclosure will be further understood upon consideration of the detailed description as well as the appended claims.

Figure 1A:
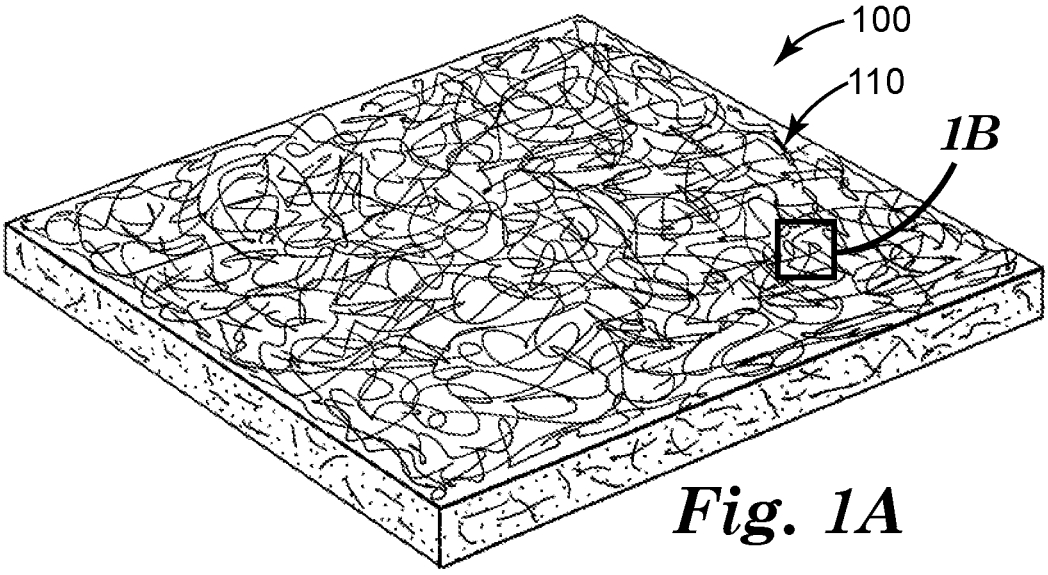
FIG. 1A is a perspective view of exemplary nonwoven abrasive article 100.

Repeated use of reference characters in the specification and drawings is intended to represent the same or analogous features or elements of the disclosure. It should be understood that numerous other modifications and embodiments can be devised by those skilled in the art, which fall within the scope and spirit of the principles of the disclosure. The figures may not be drawn to scale.

DETAILED DESCRIPTION

Nonwoven abrasive wheels, such as unitized abrasive wheels and convolute abrasive wheels, can be prepared from lofty, fibrous, bonded, nonwoven sheets or webs containing super abrasive particles such as diamond or cubic boron nitrate abrasive particles. Such sheets or webs may be manufactured through processes that include coating a curable binder precursor, typically in slurry form, on or throughout a nonwoven fibrous web. In the formation of unitized or convolute abrasive wheels, the nonwoven fiber web is typically compressed (i.e., densified) relative to nonwoven fiber webs used in lofty open nonwoven articles.

Nonwoven fiber webs suitable for use are known in the abrasives art. Typically, the nonwoven fiber web comprises an entangled web of fibers. The fibers may comprise continuous fiber, staple fiber, or a combination thereof. For example, the fiber web may comprise staple fibers having a length of at least about 20 millimeters (mm), at least about 30 mm, or at least about 40 mm, and less than about 110 mm, less than about 85 mm, or less than about 65 mm, although shorter and longer fibers (e.g., continuous filaments) may also be useful. The fibers may have a fineness or linear density of at least about 1.7 decitex (dtex, i.e., grams/10000 meters), at least about 6 dtex, or at least about 17 dtex, and less than about 560 dtex, less than about 280 dtex, or less than about 120 dtex, although fibers having lesser and/or greater linear densities may also be useful. Mixtures of fibers with differing linear densities may be useful, for example, to provide an abrasive article that upon use will result in a specifically preferred surface finish. If a spunbond nonwoven is used, the filaments may be of substantially larger diameter, for example, up to 2 mm or more in diameter.

The fiber web may be made, for example, by conventional air laid, carded, stitch bonded, spun bonded, wet laid, and/or melt blown procedures. Air laid fiber webs may be prepared using equipment such as, for example, that available under the trade designation RANDO WEBBER from Rando Machine Company of Macedon, N.Y.

Nonwoven fiber webs are typically selected to be compatible with adhering binders and abrasive particles while also being compatible with other components of the article, and typically can withstand processing conditions (e.g., temperatures) such as those employed during application and curing of the curable binder precursor. The fibers may be chosen to affect properties of the abrasive article such as, for example, flexibility, elasticity, durability or longevity, abrasiveness, and finishing properties. Examples of fibers that may be suitable include natural fibers, synthetic fibers, and mixtures of natural and/or synthetic fibers. Examples of synthetic fibers include those made from polyester (e.g., polyethylene terephthalate), nylon (e.g., hexamethylene adipamide, polycaprolactam), polypropylene, acrylonitrile (i.e., acrylic), rayon, cellulose acetate, polyvinylidene chloride-vinyl chloride copolymers, and vinyl chloride-acrylonitrile copolymers. Examples of suitable natural fibers include cotton, wool, jute, and hemp. The fiber may be of virgin material or of recycled or waste material, for example, reclaimed from garment cuttings, carpet manufacturing, fiber manufacturing, or textile processing. The fiber may be homogenous or a composite such as a bicomponent fiber (e.g., a co-spun sheath-core fiber). The fibers may be tensilized and crimped, but may also be continuous filaments such as those formed by an extrusion process. Combinations of fibers may also be used.

Prior to coating and/or impregnation with a binder precursor composition, the nonwoven fiber web typically has a weight per unit area (i.e., basis weight) of at least about 50 grams per square meter (gsm), at least about 100 gsm, or at least about 150 gsm; and/or less than about 600 gsm, less than about 500 gsm, or less than about 400 gsm, as measured prior to any coating (e.g., with the curable binder precursor or optional pre-bond resin), although greater and lesser basis weights may also be used. In addition, prior to impregnation with the curable binder precursor, the fiber web typically has a thickness of at least about 3 mm, at least about 6 mm, or at least about 10 mm; and/or less than about 100 mm, less than about 50 mm, or less than about 25 mm, although greater and lesser thicknesses may also be useful.

Frequently, as known in the abrasives art, it is useful to apply a prebond resin to the nonwoven fiber web prior to coating with the curable binder precursor. The prebond resin serves, for example, to help maintain the nonwoven fiber web integrity during handling, and may also facilitate bonding of the urethane binder to the nonwoven fiber web. Examples of prebond resins include phenolic resins, urethane resins, hide glue, acrylic resins, urea-formaldehyde resins, melamine-formaldehyde resins, epoxy resins, and combinations thereof. The amount of pre-bond resin used in this manner is typically adjusted toward the minimum amount consistent with bonding the fibers together at their points of crossing contact. In those cases, wherein the nonwoven fiber web includes thermally bondable fibers, thermal bonding of the nonwoven fiber web may also be helpful to maintain web integrity during processing.

In those nonwoven abrasive articles including a lofty open nonwoven fiber web (e.g., hand pads, and surface conditioning discs and belts, flap brushes, or nonwoven abrasive webs used to make unitized or convolute abrasive wheels) many interstices between adjacent fibers that are substantially unfilled by the binder and abrasive particles, resulting in a composite structure of extremely low density having a network on many relatively large intercommunicated voids. The resulting lightweight, lofty, extremely open fibrous construction is essentially non-clogging and non-filling in nature, particularly when used in conjunction with liquids such as water and oils. These structures also can be readily cleaned upon simple flushing with a cleansing liquid, dried, and left for substantial periods of time, and then reused. Towards these ends, the voids in these nonwoven abrasive articles may make up at least about 75 percent, and preferably more, of the total space occupied by the composite structure.

Examples of suitable curable binder precursors (e.g., suitable for the first and/or second curable binder precursor) including resole phenolic resins, novolac phenolic resins, epoxy resins, polymerizable acrylic monomers oligomers and polymers, alkyd resins, cyanate resins, aminoplast resins, urea-formaldehyde resins, urethane resins (one-part and two-part), and combinations thereof. Depending on the curable binder precursor system selected, an appropriate curative (e.g., a crosslinker, catalyst, or initiator) may also be present. Selection and amounts of suitable such curatives are well known in the abrasives art.

Curable binder compositions may contain various additives. For example, conventional resin filler(s) (e.g., calcium carbonate or fine fibers), lubricant(s) (e.g., alkali metal salts of stearic acid and light petroleum oils), grinding aid(s) (e.g., potassium fluoroborate), wetting agent(s) or surfactant(s) (e.g., sodium lauryl sulfate), defoamer(s), pigment(s), dye(s), biocide(s), coupling agent(s) (e.g., organosilanes), plasticizer(s) (e.g., polyalkylene polyols or phthalate esters), thickeners, and combinations thereof. Typically, the curable binder precursor will include at least one solvent (e.g., isopropyl alcohol, methyl ethyl ketone, water) to facilitate coating of the curable binder precursor on the nonwoven fiber web, although this is not a requirement.

In some embodiments, the curable binder precursor is a urethane prepolymer. Examples of useful urethane prepolymers include polyisocyanates and blocked versions thereof. Typically, blocked polyisocyanates are substantially unreactive to isocyanate reactive compounds (e.g., amines, alcohols, thiols) under ambient conditions (e.g., temperatures in a range of from about 20° C. to about 25° C.), but upon application of sufficient thermal energy the blocking agent is released, thereby generating isocyanate functionality that reacts with the amine curative to form a covalent bond.

Useful polyisocyanates include, for example, aliphatic polyisocyanates (e.g., hexamethylene diisocyanate or trimethylhexamethylene diisocyanate); alicyclic polyisocyanates (e.g., hydrogenated xylylene diisocyanate or isophorone diisocyanate); aromatic polyisocyanates (e.g., tolylene diisocyanate or 4,4'-diphenylmethane diisocyanate); adducts of any of the foregoing polyisocyanates with a polyhydric alcohol (e.g., a diol, low molecular weight hydroxyl group-containing polyester resin, and/or water); adducts of the foregoing polyisocyanates (e.g., isocyanurates, biurets); and mixtures thereof.

Useful commercially available polyisocyanates include, for example, those available under the trade designation ADIPRENE from Chemtura Corporation, Middlebury, Conn. (e.g., ADIPRENE L 0311, ADIPRENE L 100, ADIPRENE L 167, ADIPRENE L 213, ADIPRENE L 315, ADIPRENE L 680, ADIPRENE LF 1800A, ADIPRENE LF 600D, ADIPRENE LFP 1950A, ADIPRENE LFP 2950A, ADIPRENE LFP 590D, ADIPRENE LW 520, and ADIPRENE PP 1095); polyisocyanates available under the trade designation MONDUR from Bayer Corporation, Pittsburgh, Pa. (e.g., MONDUR 1437, MONDUR MP-095, or MONDUR 448); and polyisocyanates available under the trade designations AIRTHANE and VERSATHANE from Air Products and Chemicals, Allentown, Pa. (e.g., AIRTHANE APC-504, AIRTHANE PST-95A, AIRTHANE PST-85A, AIRTHANE PET-91A, AIRTHANE PET-75D, VERSATHANE STE-95A, VERSATHANE STE-P95, VERSATHANE STS-55, VERSATHANE SME-90A, and VERSATHANE MS-90A).

To lengthen pot-life, polyisocyanates such as, for example, those mentioned above may be blocked with a blocking agent according to various techniques known in the art. Exemplary blocking agents include ketoximes (e.g., 2-butanone oxime); lactams (e.g., epsilon-caprolactam); malonic esters (e.g., dimethyl malonate and diethyl malonate); pyrazoles (e.g., 3,5-dimethylpyrazole); alcohols including tertiary alcohols (e.g., t-butanol or 2,2-dimethylpentanol), phenols (e.g., alkylated phenols), and mixtures of alcohols as described.

Exemplary useful commercially available blocked polyisocyanates include those marketed by Chemtura Corporation under the trade designations ADIPRENE BL 11, ADIPRENE BL 16, ADIPRENE BL 31, ADIPRENE BL 46, and ADIPRENE BL 500; and blocked polyisocyanates marketed by Baxenden Chemicals, Ltd., Accrington, England under the trade designation TRIXENE (e.g., TRIXENE BL 7641, TRIXENE BL 7642, TRIXENE BL 7772, and TRIXENE BL 7774).

Typically, the amount of any urethane prepolymer present in the curable binder precursor is in an amount of from 10 to 40 percent by weight, more typically in an amount of from 15 to 30 percent by weight, and even more typically in an amount of from 20 to 25 percent by weight based on the total weight of the curable binder precursor, although amounts outside of these ranges may also be used.

Exemplary curatives for urethane prepolymers include aromatic, alkyl-aromatic, or alkyl polyfunctional amines, preferably primary amines. Examples of useful amine curatives include 4,4'-methylenedianiline; polymeric methylene dianilines having a functionality of 2.1 to 4.0 which include those known under the trade designations CURITHANE 103, commercially available from the Dow Chemical Company, and MDA-85 from Bayer Corporation, Pittsburgh, Pa.; 1,5-diamine-2-methylpentane; tris(2-aminoethyl) amine; 3-aminomethyl-3,5,5-trimethylcyclohexylamine (i.e., isophoronediamine), trimethylene glycol di-p-aminobenzoate, bis(o-aminophenylthio)ethane, 4,4'-methylenebis(dimethyl anthranilate), bis(4-amino-3-ethylphenyl)methane (e.g., as marketed under the trade designation KAYAHARD AA by Nippon Kayaku Company, Ltd., Tokyo, Japan), and bis(4-amino-3,5-diethylphenyl)methane (e.g., as marketed under the trade designation LONZACURE M-DEA by Lonza, Ltd., Basel, Switzerland), and mixtures thereof. If desired, polyol(s) may be added to the curable binder precursor, for example, to modify (e.g., to retard) cure rates as required by the intended use. The amine curative should be present in an amount effective (i.e., an effective amount) to cure the blocked polyisocyanate to the degree required by the intended application; for example, the amine curative may be present in a stoichiometric ratio of curative to isocyanate (or blocked isocyanate) in a range of from 0.8 to 1.35; for example, in a range of from 0.85 to 1.20, or in a range of from 0.90 to 0.95, although stoichiometric ratios outside these ranges may also be used.

One method of making nonwoven abrasive articles according to the present invention includes the steps in the following order: applying a prebond coating to the nonwoven fiber web (e.g., by roll-coating or spray coating), curing the prebond coating, impregnating the nonwoven fiber web with a make layer precursor having a first curable binder precursor (e.g., commonly termed a "make coat", by roll-coating or spray coating), applying abrasive particles to the curable binder precursor, optionally applying a second curable binder precursor (which may be the same or different) over the make layer precursor and abrasive particles (commonly termed a "size coat" or "size layer precursor") and then curing the curable binder precursor(s).

The amount of curable binder precursor in the make layer precursor (and optional size layer precursor) should generally be sufficient that the abrasive platelets are firmly adhered to the nonwoven fiber web in the finished article, but not so great that appreciable amounts of the abrasive platelets (e.g., less than 10 percent, less than 5 percent, less than 2 percent) are deposited on top of other abrasive platelets to form a double layer. In some embodiments, curable binder precursor(s) (excluding any solvent that may be present) is/are preferably coated onto the nonwoven fiber web in an amount of from 25 to 1000 grams per square meter (gsm), more preferably 100 to 1000 gsm, and even more preferably 75 to 750 gsm, although values outside these ranges may also be used.

Useful abrasive platelets may be the result of a crushing operation (e.g., crushed abrasive particles that have been sorted for shape and size) or the result of a shaping operation (i.e., shaped abrasive platelets) in which an abrasive precursor material is shaped (e.g., molded), dried, and converted to ceramic material. Combinations of abrasive platelets resulting from crushing with abrasive platelets resulting from a shaping operation may also be used. The abrasive platelets may be in the form of, for example, individual particles, agglomerates, composite particles, and mixtures thereof.

The abrasive platelets should have sufficient hardness and surface roughness to function as crushed abrasive particles in abrading processes. Preferably, the abrasive platelets have a Mohs hardness of at least 4, at least 5, at least 6, at least 7, or even at least 8.

Crushed abrasive platelets can be obtained from commercial sources, by known methods, and/or by shape sorting crushed abrasive particles; for example, using a shape-sorting table as is known in the art.

Suitable abrasive particles (including abrasive platelets and optionally blocky or needle-shape abrasive particles) that may be included in nonwoven abrasive articles according to the present disclosure include crushed abrasive particles comprising fused aluminum oxide, heat-treated aluminum oxide, white fused aluminum oxide, ceramic aluminum oxide materials such as those commercially available as 3M CERAMIC ABRASIVE GRAIN from 3M Company, St. Paul, Minn., brown aluminum oxide, blue aluminum oxide, silicon carbide (including green silicon carbide), titanium diboride, boron carbide, tungsten carbide, garnet, titanium carbide, diamond, cubic boron nitride, garnet, fused alumina zirconia, iron oxide, chromia, zirconia, titania, tin oxide, quartz, feldspar, flint, emery, sol-gel-derived ceramic (e.g., alpha alumina), and combinations thereof. Examples of sol-gel-derived abrasive particles from which the abrasive platelets can be isolated, and methods for their preparation can be found, in U.S. Pat. Nos. 4,314,827 (Leitheiser et al.); 4,623,364 (Cottringer et al.); 4,744,802 (Schwabel), 4,770,671 (Monroe et al.); and 4,881,951 (Monroe et al.). It is also contemplated that the abrasive particles could comprise abrasive agglomerates such, for example, as those described in U.S. Pat. Nos. 4,652,275 (Bloecher et al.) or 4,799,939 (Bloecher et al.). In some embodiments, the abrasive particles may be surface-treated with a coupling agent (e.g., an organosilane coupling agent) or other physical treatment (e.g., iron oxide or titanium oxide) to enhance adhesion of the crushed abrasive particles to the binder. The abrasive particles may be treated before combining them with the binder, or they may be surface treated in situ by including a coupling agent to the binder.

Preferably, the abrasive particles (and especially the abrasive platelets) comprise ceramic abrasive particles such as, for example, sol-gel-derived polycrystalline alpha alumina particles. Ceramic abrasive particles composed of crystallites of alpha alumina, magnesium alumina spinel, and a rare earth hexagonal aluminate may be prepared using sol-gel precursor alpha alumina particles according to methods described in, for example, U.S. Pat. No. 5,213,591 (Celikkaya et al.) and U.S. Publ. Pat. Appln. Nos. 2009/0165394 A1 (Culler et al.) and 2009/0169816 A1 (Erickson et al.).

Further details concerning methods of making sol-gel-derived abrasive particles can be found in, for example, U.S. Pat. Nos. 4,314,827 (Leitheiser); 5,152,917 (Pieper et al.); 5,435,816 (Spurgeon et al.); 5,672,097 (Hoopman et al.); 5,946,991 (Hoopman et al.); 5,975,987 (Hoopman et al.); No. 6,129,540 (Hoopman et al.); and in U.S. Publ. Pat. Appln. No. 2009/0165394 A1 (Culler et al.).

A majority of the abrasive particles are abrasive platelets. The abrasive platelets preferably comprise at least 50 weight percent of the total weight of abrasive particles included in the nonwoven abrasive article, preferably at least 55 weight percent, at least 60 weight percent, at least 65 weight percent, at least 70 weight percent, at least 75 weight percent, at least 80 weight percent, at least 85 weight percent, at least 90 weight percent, at least 95 weight percent, at least 99 weight percent, or even 100 weight percent, although this is not a requirement.

In some preferred embodiments, useful abrasive particles (especially in the case of the abrasive platelets) may be shaped abrasive particles can be found in U.S. Pat. Nos. 5,201,916 (Berg); 5,366,523 (Rowenhorst (Re 35,570)); and 5,984,988 (Berg). U.S. Pat. No. 8,034,137 (Erickson et al.) describes alumina abrasive particles that have been formed in a specific shape, then crushed to form shards that retain a portion of their original shape features. In some embodiments, shaped alpha alumina particles are precisely-shaped (i.e., the particles have shapes that are at least partially determined by the shapes of cavities in a production tool used to make them. Details concerning such abrasive particles and methods for their preparation can be found, for example, in U.S. Pat. Nos. 8,142,531 (Adefris et al.); 8,142,891 (Culler et al.); and 8,142,532 (Erickson et al.); and in U.S. Pat. Appl. Publ. Nos. 2012/0227333 (Adefris et al.); 2013/0040537 (Schwabel et al.); and 2013/0125477 (Adefris).

Surface coatings on the abrasive particles may be used to improve the adhesion between the crushed abrasive particles and a binder in abrasive articles, or can be used to aid in electrostatic deposition of the abrasive particles. In one embodiment, surface coatings as described in U.S. Pat. No. 5,352,254 (Celikkaya) in an amount of 0.1 to 2 percent surface coating to abrasive particle weight may be used. Such surface coatings are described in U.S. Pat. Nos. 5,213,591 (Celikkaya et al.); 5,011,508 (Wald et al.); 1,910,444 (Nicholson); 3,041,156 (Rowse et al.); 5,009,675 (Kunz et al.); 5,085,671 (Martin et al.); 4,997,461 (Markhoff-Matheny et al.); and 5,042,991 (Kunz et al.). Additionally, the surface coating may prevent shaped abrasive particles from capping. Capping is the term to describe the phenomenon where metal particles from the workpiece being abraded become welded to the tops of the abrasive particles. Surface coatings to perform the above functions are known to those of skill in the art.

The abrasive platelets may be selected to have a length and/or width in a range of from 0.1 micrometers to 3.5 millimeters (mm), more typically 0.05 mm to 3.0 mm, and more typically 0.1 mm to 2.6 mm, although other lengths and widths may also be used.

The abrasive platelets may be selected to have a thickness in a range of from 0.1 micrometer to 1.6 mm, more typically from 1 micrometer to 1.2 mm, although other thicknesses may be used. In some embodiments, platey crushed abrasive particles may have an aspect ratio (length to thickness) of at least 2, 3, 4, 5, 6, or more.

In some preferred embodiments, the abrasive platelets comprise shaped abrasive platelets bounded by upper and lower surfaces with a plurality of sidewalls disposed therebetween. Examples include platelets shaped as a truncated triangular prism or truncated triangular pyramid.

Length, width, and thickness of the abrasive platelets can be determined on an individual or average basis, as desired. Suitable techniques may include inspection and measurement of individual particles, as well as using automated image analysis techniques (e.g., using a dynamic image analyzer such as a CAMSIZER XT image analyzer from Retsch Technology Gmbh of Haan, Germany) according to test method ISO 13322-2:2006 "Particle size analysis—Image analysis methods—Part 2: Dynamic image analysis methods".

Preferably, the abrasive platelets nominally have the same size and shape although this is not a requirement.

Suitable abrasive particles (including abrasive platelets as well as other shapes) may be independently sized according to an abrasives industry recognized specified nominal grade. Exemplary abrasive industry recognized grading standards include those promulgated by ANSI (American National Standards Institute), FEPA (Federation of European Producers of Abrasives), and JIS (Japanese Industrial Standard). ANSI grade designations (i.e., specified nominal grades) include, for example: ANSI 4, ANSI 6, ANSI 8, ANSI 16, ANSI 24, ANSI 36, ANSI 46, ANSI 54, ANSI 60, ANSI 70, ANSI 80, ANSI 90, ANSI 100, ANSI 120, ANSI 150, ANSI 180, ANSI 220, ANSI 240, ANSI 280, ANSI 320, ANSI 360, ANSI 400, and ANSI 600. FEPA grade designations include F4, F5, F6, F7, F8, F10, F12, F14, F16, F16, F20, F22, F24, F30, F36, F40, F46, F54, F60, F70, F80, F90, F100, F120, F150, F180, F220, F230, F240, F280, F320, F360, F400, F500, F600, F800, F1000, F1200, F1500, and F2000. JIS grade designations include JIS8, JIS12, JIS16, JIS24, JIS36, JIS46, JIS54, JIS60, JIS80, JIS100, JIS150, JIS180, JIS220, JIS240, JIS280, JIS320, JIS360, JIS400, JIS600, JIS800, JIS1000, JIS1500, JIS2500, JIS4000, JIS6000, JIS8000, and JIS10,000

Alternatively, the crushed abrasive particles can be graded to a nominal screened grade using U.S.A. Standard Test Sieves conforming to ASTM E-11 "Standard Specification for Wire Cloth and Sieves for Testing Purposes". ASTM E-11 prescribes the requirements for the design and construction of testing sieves using a medium of woven wire cloth mounted in a frame for the classification of materials according to a designated particle size. A typical designation may be represented as −18+20 meaning that the crushed abrasive particles pass through a test sieve meeting ASTM E-11 specifications for the number 18 sieve and are retained on a test sieve meeting ASTM E-11 specifications for the number 20 sieve. In one embodiment, the crushed abrasive particles have a particle size such that most of the particles pass through an 18 mesh test sieve and can be retained on a 20, 25, 30, 35, 40, 45, or 50 mesh test sieve. In various embodiments, the crushed abrasive particles can have a nominal screened grade of: —18+20, −20/+25, −25+30, −30+35, −35+40, 5+40+45, −45+50, −50+60, −60+70, −70/+80, −80+100, −100+120, −120+140, −140+170, −170+200, −200+230, −230+270, −270+325, −325+400, −400+450, −450+500, or −500+635. Alternatively, a custom mesh size can be used such as −90+100.

Typically, the coating weight for the abrasive particles (independent of other ingredients in the curable binder precursor) may depend, for example, on the particular binder used, the process for applying the abrasive particles, and the size of the abrasive particles. For example, the coating weight of the abrasive particles on the nonwoven fiber web (before any compression) may be at least 100 grams per square meter (gsm), at least 600 gsm, or at least 800 gsm; and/or less than 3000 gsm, less than about 2000 gsm, or less than about 1000 gsm, although greater or lesser coating weights may be also be used. Electrostatic coating is used to apply the abrasive platelets to the make coat-treated nonwoven fiber web. During electrostatic coating, electrostatic charges are applied to the abrasive particles and this creates a difference in potential between the particles and nonwoven web which is electrically grounded. The difference in potential attracts the abrasive particles to the nonwoven web. Electrostatic coating tends to orient the abrasive particles, which tends to lead to better abrading performance.

One useful electrostatic coating apparatus has a conveyor belt moving through an electrostatic field. A coater applies a make layer precursor coating onto the nonwoven fiber web, which follows a web path guiding the nonwoven through the electrostatic field above the conveyor belt. A particle feeder applies the abrasive particles to form a layer of abrasive particles on the conveyor belt. As the conveyor belt moves the particle layer through the electrostatic field, abrasive particles are transferred upward to the make layer precursor-coated nonwoven fiber web from the conveyor belt. Further details concerning this type of particle coating process as applied to manufacture of a coated abrasive article can be found in, U. S. Pat. No. 8,869,740 B2 (Moren et al.), except that a nonwoven fiber web should be substituted for the backing.

The resulting construction is exposed to conditions sufficient to solidify the make layer precursor. Details concerning voltages and deposition rates for specific binder precursor-coated nonwoven fiber webs can be readily determined by those of skill in the art. Electrostatic coating may be carried out toward one or both sides of the binder precursor-coated nonwoven fiber web. Other methods of electrostatic coating may also be used such as projecting particles towards the nonwoven web using normal spraying methods, and then orienting the particles on the fibers by an applied electrostatic charge.

At this point a size layer precursor may optionally be applied over at least a portion of the make layer precursor and abrasive particles (e.g., abrasive platelets) platelets. The size layer precursor comprises a second curable binder precursor which may be the same as, or different from, the make layer precursor. Any material used in the make layer precursor may also be used in the size layer precursor, for example. Likewise, process conditions for the make layer precursor may also be used to coat and cure the size layer precursor to form a size layer disposed on at least a portion of the make layer and abrasive particles. The resulting construction is exposed to conditions sufficient to solidify the size layer precursor.

As a result of the electrostatic coating process, typically in combination with controlling the amount of binder precursor to avoid excess, the abrasive platelets can be oriented such that they are orthogonal to the respective at least one fiber to which they are bonded. Moreover, the abrasive platelets can be arranged, in at least some embodiments, such that they are substantially orthogonal to at least one fiber to which it is bonded (i.e., forming an angle with the fiber of from 70 to 110 degrees, preferably 80 to 100 degrees).

The present inventors have found that conventional electrospray processes are generally inefficient for practicing the present disclosure.

Figure 1B:
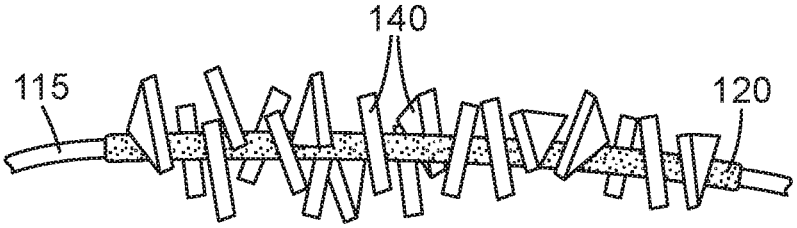
FIG. 1B is an enlarged view of region 1B of nonwoven abrasive article 100 shown in FIG. 1A.

An exemplary embodiment of a nonwoven abrasive article 100 is shown in FIGS. 1A and 1B. Lofty open low-density fibrous web 110 is formed of entangled filaments 115 held together by binder 120. Abrasive platelets 140 are secured to fibrous web 110 on exposed surfaces of filaments 115 by binder 120. A majority of abrasive platelets 140 are oriented orthogonal to at least one fiber to which it is bonded resulting in cutting points 150 being outwardly oriented relative to the fiber.

Figure 2:
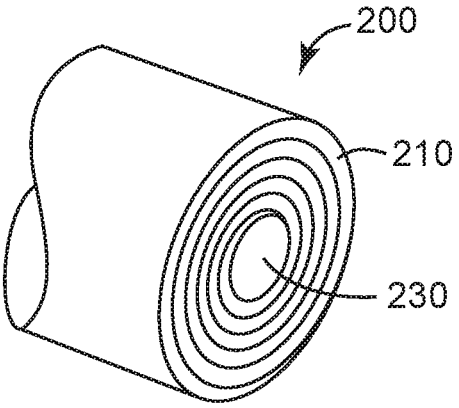
FIG. 2 is a perspective view of exemplary convolute abrasive wheel 200.

Convolute abrasive wheels may be made, for example, by winding the nonwoven fiber web, after the size layer precursor has been applied to the make layer and abrasive particles and partially cured, under tension around a core member (e.g., a tubular or rod-shaped core member) such that the impregnated nonwoven fiber layers become compressed, and then fully curing the size layer precursor. A convolute abrasive wheel 200 is shown in FIG. 2, wherein nonwoven fiber web 210 is coated with a binder that secures the abrasive particles (e.g., as in FIGS. 1A and 1B) to the layered nonwoven fiber web and binds layers of the layered nonwoven fiber web 210 to each other. The nonwoven fiber web 210 is spirally disposed around and affixed to core member 230. If desired, convolute abrasive wheels may be dressed prior to use to remove surface irregularities, for example, using methods known in the abrasive arts.

Figure 3:
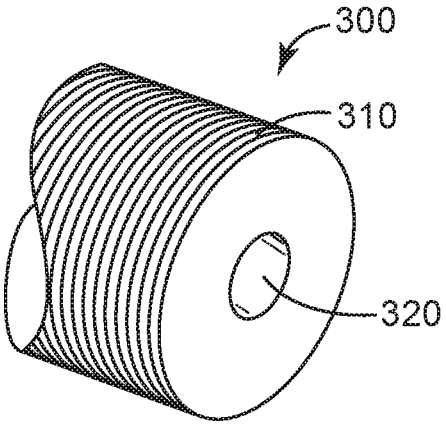
FIG. 3 is a perspective view of exemplary unitized abrasive wheel 300.

Similarly, unitized abrasive wheels can be made, for example, as with convolute wheels, except that instead of winding the size layer precursor coated web, it is stacked and compressed prior to curing. A unitized nonwoven abrasive wheel 300 is shown in FIG. 3 having a plurality of nonwoven abrasive layers 310, which have been compressed and cured. After curing the curable binder precursor, the resulting fused slab can be die cut to form the abrasive wheel having a central hole 320.

When compressing the layers of impregnated nonwoven fiber web in making an abrasive wheel, the one or more layers are typically compressed to form a slab having a density that is from 1 to 10 times that of the density of the layers in their non-compressed state. The slab is then typically subjected to heat molding (e.g., for from 2 to 20 hours) at elevated temperature (e.g., at 135° C.), typically depending on the curable binder precursor selected and slab/bun size.

In addition to the foregoing abrasive wheels, methods of making nonwoven abrasive articles according to the present disclosure are useful for preparing hand pads, floor pads, flap brushes, surface conditioning pads, discs, and belts, for example.

Further details concerning nonwoven abrasive articles, abrasive wheels and methods for their manufacture may be found, for example, in U.S. Pat. Nos. 2,958,593 (Hoover et al.); 5,591,239 (Larson et al.); 6,017,831 (Beardsley et al.); and in U.S. Pat. Appl. Publ. 2006/0041065 A 1 (Barber, Jr.).

SELECT EMBODIMENTS OF THE PRESENT DISCLOSURE

In a first embodiment, the present disclosure provides a nonwoven abrasive article comprising:

a lofty open nonwoven fiber web comprising entangled fibers; and abrasive platelets secured to the entangled fibers by at least one binder material, and wherein a majority of the abrasive platelets are respectively bonded in an edge-wise manner to at least one of the entangled fibers, respectively.

In a second embodiment, the present disclosure provides a nonwoven abrasive article according to the first embodiment, wherein the abrasive platelets comprise triangular shaped abrasive platelets.

In a third embodiment, the present disclosure provides a nonwoven abrasive article according to the first or second embodiment, wherein the abrasive platelets are closely-packed along the lengths of the entangled fibers.

In a fourth embodiment, the present disclosure provides a nonwoven abrasive article according to any one of the first to third embodiments, wherein the nonwoven abrasive article comprises: a hand pad; a floor pad; flap brush; or a surface conditioning pad, disc, or belt.

In a fifth embodiment, the present disclosure provides a nonwoven abrasive article according to any one of the first to fourth embodiments, wherein the abrasive platelets nominally have the same size and shape.

In a sixth embodiment, the present disclosure provides a nonwoven abrasive article according to any one of the first to fifth embodiments, wherein a majority of the abrasive platelets are arranged such that they are orthogonal to the entangled fibers to which they are bonded.

In a seventh embodiment, the present disclosure provides a nonwoven abrasive article according to any one of the first to sixth embodiments, wherein the abrasive platelets comprise shaped abrasive platelets bounded by upper and lower surfaces and a plurality of sidewalls disposed therebetween.

In an eighth embodiment, the present disclosure provides a convolute nonwoven abrasive wheel comprising a spirally wound and compressed nonwoven abrasive article according to any one of the first to seventh embodiments.

In a ninth embodiment, the present disclosure provides a method of making an abrasive article, comprising the steps:

i) providing a lofty open nonwoven fiber web comprising a plurality of entangled fibers;

ii) coating at least a portion of the lofty open nonwoven fiber web with a first curable binder precursor to provide a coated fiber web;

iii) electrostatically depositing a plurality of abrasive platelets on at least a portion of the first curable binder precursor; and iv) at least partially curing the first curable binder, wherein a majority of the abrasive platelets are each bonded in an edge-wise manner to at least one of the entangled fibers, respectively.

In a tenth embodiment, the present disclosure provides a method according to the ninth embodiment, further comprising coating at least a portion of the first curable binder precursor and abrasive platelets with a second curable binder precursor, and at least partially curing the second binder precursor.

In an eleventh embodiment, the present disclosure provides a method according to the ninth or tenth embodiment, further comprising converting the nonwoven abrasive web into at least one of at least one hand pad; at least one floor pad; at least one flap brush; or at least one surface conditioning pad, disc, or belt.

In a twelfth embodiment, the present disclosure provides a method according to the ninth or tenth embodiment, further comprising;

v) converting the nonwoven abrasive article into at least one of a convolute abrasive wheel or unitized abrasive wheel.

In a thirteenth embodiment, the present disclosure provides a method according to any one of the ninth to twelfth embodiments, wherein the abrasive platelets comprise triangular shaped abrasive platelets.

In a fourteenth embodiment, the present disclosure provides a method according to any one of the ninth to thirteenth embodiments, wherein the abrasive platelets are closely-packed along the lengths of the entangled fibers.

In a fifteenth embodiment, the present disclosure provides a method according to any one of the ninth to fourteenth embodiments, wherein a majority of the abrasive platelets are arranged such that they are orthogonal to the entangled fibers to which they are bonded.

In a sixteenth embodiment, the present disclosure provides a method according to any one of the ninth to fifteenth embodiments, wherein the abrasive platelets comprise shaped abrasive platelets.

Objects and advantages of this disclosure are further illustrated by the following non-limiting examples, but the particular materials and amounts thereof recited in these examples, as well as other conditions and details, should not be construed to unduly limit this disclosure.

EXAMPLES

Unless otherwise noted, all parts, percentages, ratios, etc. in the Examples and the rest of the specification are by weight.

Materials

TABLE 1

| ABBREVIATION | DESCRIPTION |
|---|---|
| A1 | acrylic resin emulsion, obtained as RHOPLEX TR-407 from Rohm and Haas Co., Philadelphia, Pennsylvania |
| A2 | acrylic resin emulsion, obtained as RHOPLEX GL-720 from Rohm and Haas Co. |
| WU | waterborne polyurethane dispersion, obtained as WITCOBOND W-290H from Chemtura Corp., Middlebury, Connecticut |
| PU1 | blocked urethane prepolymer, obtained as ADIPRENE BL46 from Chemtura Corp. |
| PU2 | blocked urethane prepolymer, obtained as ADIPRENE BLM500 from Chemtura Corp. |
| PU3 | blocked urethane prepolymer, obtained as ADIPRENE BL16 from Chemtura Corp. |
| CUR | aromatic amine curative, obtained as LAPOX AH664 from Atul Americas Inc., Charlotte, North Carolina |
| CUR2 | aromatic amine curative, obtained as LAPOX K-450 from Atul Americas Inc. |
| PR | phenolic resin, obtained as ARCLIN 80 5077A from Arclin Inc, Atlanta ,Georgia |
| POL | polyol, obtained as ARCOL LG-650 from Bayer MaterialScience, Ltd, Pittsburgh, Pennsylvania |
| DYN | nonionic surfactant, obtained as DYNOL 604 from Air Products and Chemicals, Inc., Allentown, Pennsylvania |
| ER1 | epoxy novolac resin, obtained as DEN 438 from Dow Chemical Co., Midland, Michigan |
| KBF4 | micropulverized potassium fluoroborate from Atotech USA, Rock Hill, South Carolina |
| PMA | propylene glycol monomethyl ether acetate, obtained as DOWANOL PMA from Dow Chemical Co. |
| LiSt | lithium stearate, obtained as LIC 17 from Baerlocher USA, Cincinnati, Ohio |
| SILICA | amorphous silica, obtained as SYLISIA 356 from Fuji Sylisia Chemical Ltd., Research Triangle Park, North Carolina |
| PEG | polyethylene glycol, obtained as PEG 6000 DS from The Hallstar Co., Chicago, Illinois |
| CaSt | calcium silicate, obtained as WOLLASTOCOAT 10072 from NYCO Minerals, Willsboro, New York |

TABLE 1-continued

| ABBREVIATION | DESCRIPTION |
|---|---|
| ER2 | white epoxy resin, obtained from Ferro Corporation, Edison, New Jersey |
| UVA | UV absorber, obtained as TINUVIN 5151 from Ciba Specialty Chemical Corporation, Tarrytown, New York |
| SAP1 | Triangular ceramic alumina particle that passes through a 40-mesh sieve and is retained upon a 50-mesh sieve, which gives an average particle size of 0.014 in (0.36 mm). |
| SAP2 | Triangular ceramic alumina particle that passes through a 70-mesh sieve and is retained upon a 80-mesh sieve, which gives an average particle size of 0.008 in (0.20 mm). |
| Black | Black Colorant, obtained as 1991 B BLACK, from EPS, Marengo, IL. |
| Green | Green Colorant, obtained as D PHTHALO GREEN, from EPS, Marengo, IL. |
| DF | Defoamer, obtained as DAPRO DF 880, from Elementis, Hightstown, NJ. |
| PME | propylene glycol monomethyl ether, obtained as DOWANOL PM from Dow Chemical Company, Midland, Michigan |
| CA | Curing agent, obtained as EPI-CURE 3105 from Momentive Specialty Chemicals, Inc., Columbus, Ohio |
| AL | Petroleum oil, obtained as Ace Filter Oil 23N from Lubrication Technologies, Inc., Golden Valley, Minnesota |
| BC | Bentonite clay, obtained as Volclay 325 from American Colloid Company, Arlington Heights, Illinois |
| MIN | Aluminum oxide mineral, obtained as Duralum Brown Aluminum Oxide, Grade 100/150 from Washington Mills Electro Minerals Corporation, Niagara Falls, New York |

Orientation Test

Three 100× photomicrographs are taken of representative areas of the surface of the particle-coated web. The photomicrographs are then inspected to determine the qualitative orientation of the particles with respect to the fibers of the web. A particle is counted as radially oriented if it is bound to the fiber surface by a point or an edge. A particle is counted as tangentially oriented if it is bound to the fiber surface on a major face. In addition, at the attachment point of each particle, the distance from the center of the fiber to the distal end of the particle is measured.

Wheel Abrasion Test

A 6 in. (15.24 cm) diameter 0.5 in. (1.27 cm) thick test wheel is mounted on the spindle of a stationary Baldor three horsepower motor. A 2.0 in. (5.08 cm) diameter by 0.125 in. (3.175 mm) thick stainless steel tube workpiece is mounted onto a Slo-Syn single phase synchronous motor (SS700) that is attached to a moveable carriage. The workpiece is set to rotate around its longitudinal axis at 32 rpm using the Slo-Syn motor, and the abrasive wheel is set to rotate at 3450 rpm using the Baldor motor. The end of the workpiece is urged against the circumference abrasive wheel at selectable loads of either 8 lb (3.6 kg) or 10 lb (4.5 kg) while being rotated around its longitudinal axis. During the test, the end of the pre-weighed rotating tube is urged against the pre-weighed wheel at the selected test load for 15-second intervals followed by a noncontact period of 15 seconds. Each Abrasion Test runs for a total of 30 minutes with the total time the workpiece contacted the wheel being 15 minutes. Total Cut is determined by the weight loss of the workpiece and the Wheel Wear is determined by the weight loss of the abrasive wheel. Results are reported as Cut and Wear in grams for each test wheel at each test load.

Disc Abrasion Test

A 3 in. (7.62 cm) diameter nonwoven abrasive disc to be tested is mounted on an 3 horsepower, electric servo motor that is disposed over an X-Y table having a 1018 carbon steel panel measuring 6 in.×14 in.×½ in. (150 mm×360 mm×13 mm) secured to the X-Y table. The rotary tool is then activated to rotate at 9000 rpm under no load. The abrasive article is then urged at an angle of 5 degrees against the panel at a load of 3 lbs (1.4 kg). The tool is then set to traverse a 12.53 in. (318.3 mm) path at a rate of 4.7 inches/second (120 mm/sec) in the −X direction; followed by a 0.290 in. (7.35 mm) path in the −Y direction at a rate of 14.0 inches/second (356 mm/sec); followed by a 12.53 in. (318.3 mm) path at a rate of 4.7 in./second (120 mm/sec) in the +X direction; followed by a 0.290 in. (7.35 mm) path in the −Y direction at a rate of 14.00 inches/second (355.6 mm/sec). This sequence is repeated 10 times for a total of 20 passes in the X direction. Twenty such passes along the length of the panel are completed in each cycle for a total of 8 cycles. The mass of the panel is measured before and after each cycle and added together to calculate a cumulative mass loss (cut) at the end of 8 cycles. The disc is weighed before and after the completion of the test (8 cycles) to determine the wear. The number of samples tested for each example is reported in Table 3.

Preparation of Nonwoven Prebond Web

A nonwoven web was formed on an air laid fiber web forming machine available under the trade designation RANDO-WEBBER from the Rando Machine Corporation of Macedon, N.Y. The fiber web was formed from 25% 64 dtex (58 d) nylon 6,6 fiber and 75% 78 dtex (70 d) nylon 6 fiber. The weight of the web was approximately 415 grams per square meter (gsm) (99 grains/24 sq. in.) The nonwoven web was secured to a woven scrim (16×16 plain weave nylon STYLE 6713531, Highland Industries, Inc., Greensboro, N.C.) by needle tacking. The web was conveyed to a two-roll coater where a pre-bond resin was applied at a dry add-on weight of 586 gsm (140 grain/24 sq. in.). The pre-bond resin had the following composition (all percentages relative to component weight): 54.1% PU3, 19.9% CUR2 and 26% PMA. The pre-bond resin was cured to a non-tacky condition by passing the coated web through a convection oven at 330° F. (166° C.) for 4.5 minutes, yielding a pre-bonded, nonwoven web composite of approximately 5.8 mm thickness and having a basis weight of 1147 gsm (274 grains/24 sq. in.).

Comparative Example A

Onto the prebond described above, an adhesive consisting of 51% PR, 46.8% water, 2.1% POL and 0.1% DYN was sprayed to a 210 gsm wet add-on. 402 gsm of SAP1 abrasive particles was then applied to the wet coating by drop coating. The particle coated web was then heated in a convection oven for 15 minutes at 88° C. (190° F.), 15 minutes at 107° C. (225° F.), and finally 15 minutes at 163° C. (325° F.). The resulting composite was evaluated by the Orientation Test. Three replicates were prepared. Orientation Test results are reported in Tables 2 and 3.

Comparative Example B

Comparative Example B was made identically to Comparative Example A, except that the adhesive was sprayed to a 420 gsm wet add-on. Orientation Test results are reported in Tables 2 and 3.

Example 1

Example 1 was made identically to Comparative Example A, except that the abrasive particles were applied by electrostatic coating. The particles were placed in contact with a plate which was then charged to an electric potential of 11 kV. The particles were electrostatically transferred against gravity to the adhesive coated surface of the web that was attached to a grounded plate. The particles traveled vertically under the force of the electrostatic field and were deposited and radially oriented onto individual fibers of the nonwoven web. Orientation Test results are reported in Tables 2 and 3.

Example 2

Example 2 was made identically to Example 1, except that 50% of the abrasive particles were applied by drop coating (first) and 50% subsequently coated electrostatically. Orientation Test results are reported in Tables 2 and 3.

TABLE 2

Figure 4:
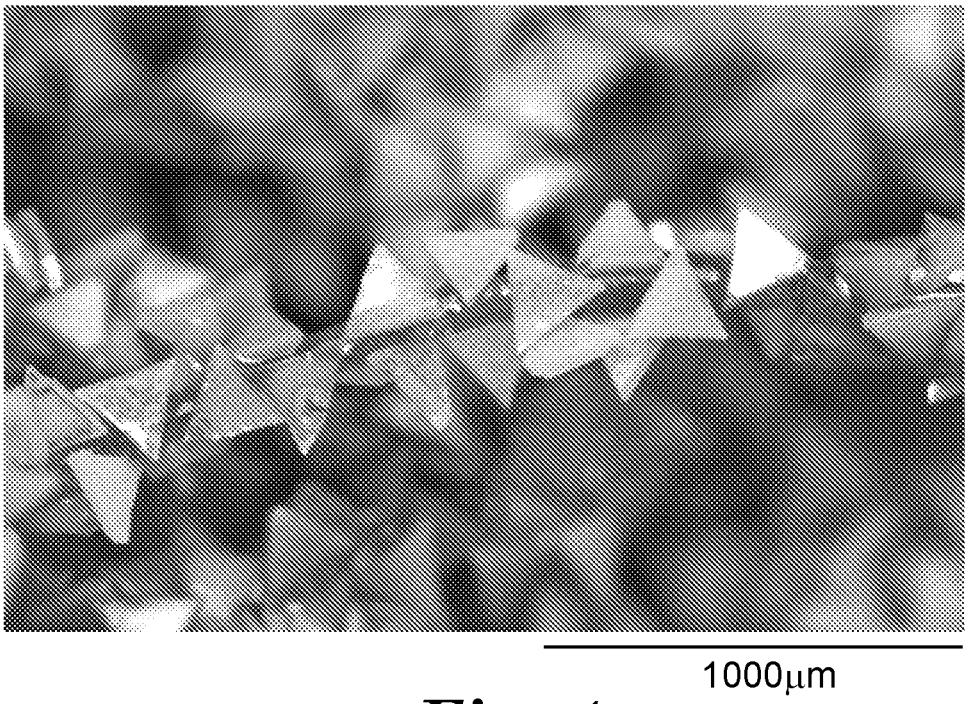
Fig. 4 PRIOR ART
FIGS. 4-15 are photomicrographs of nonwoven abrasive articles prepared in the Examples section hereinbelow.
Figure 5:
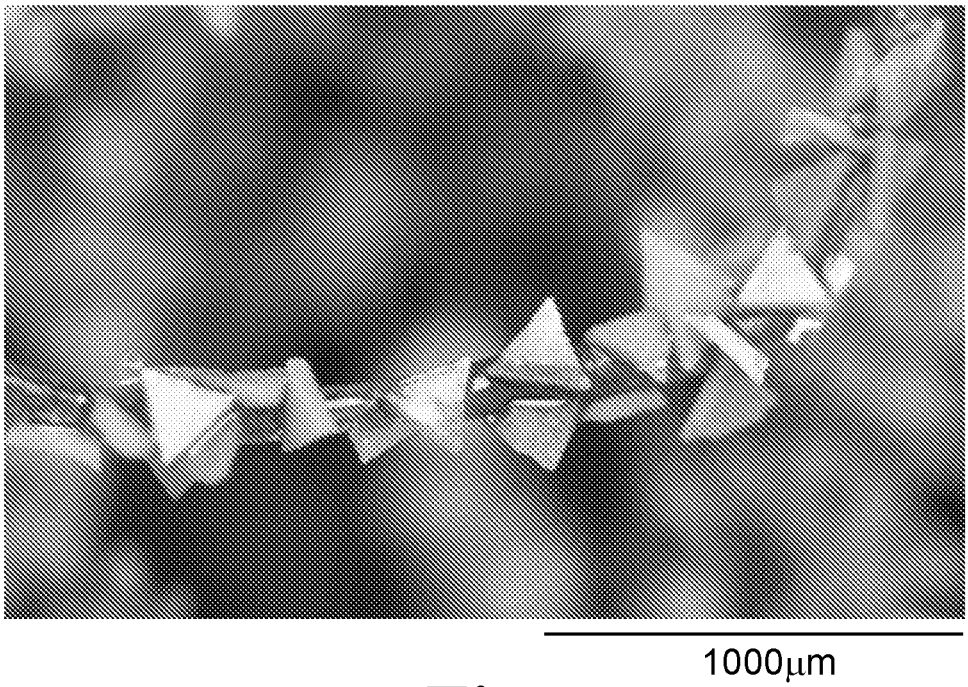
Fig. 5 PRIOR ART
Figure 6:
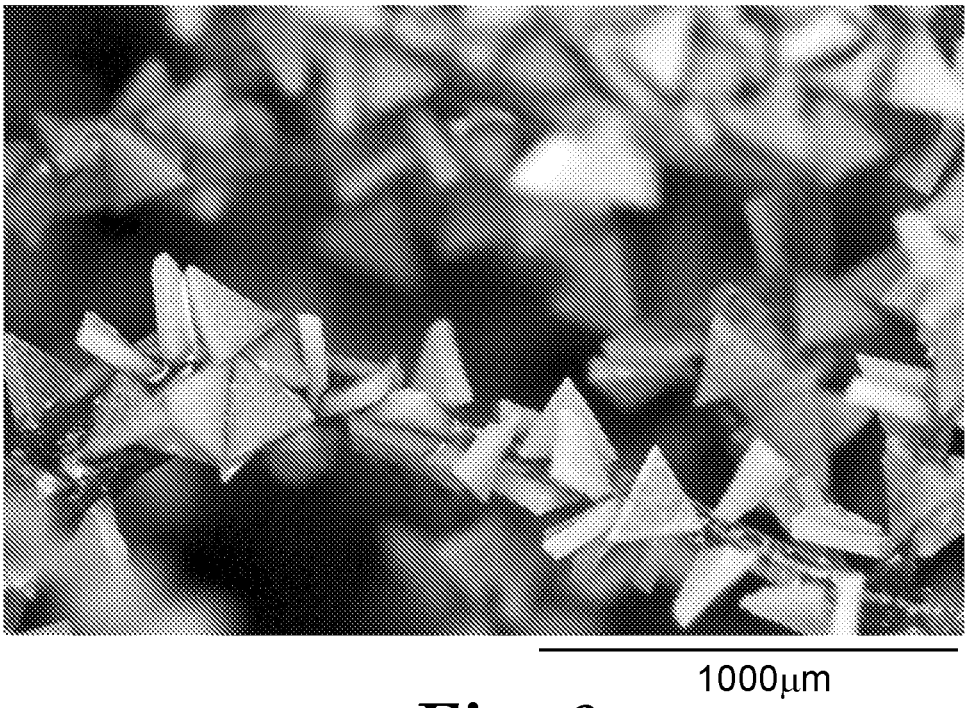
Figure 7:
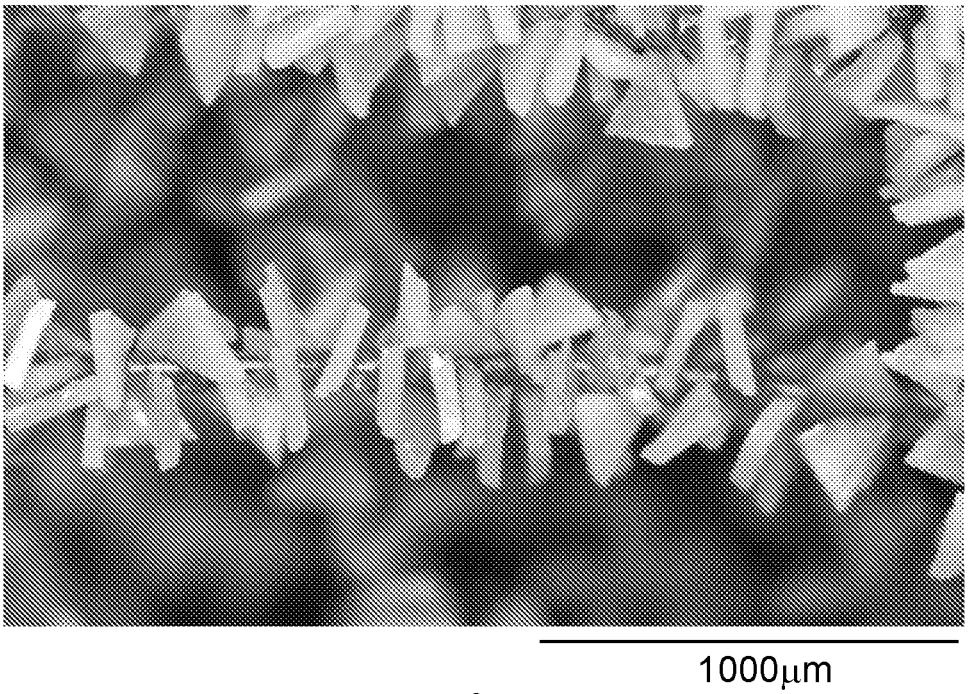
Figure 8:
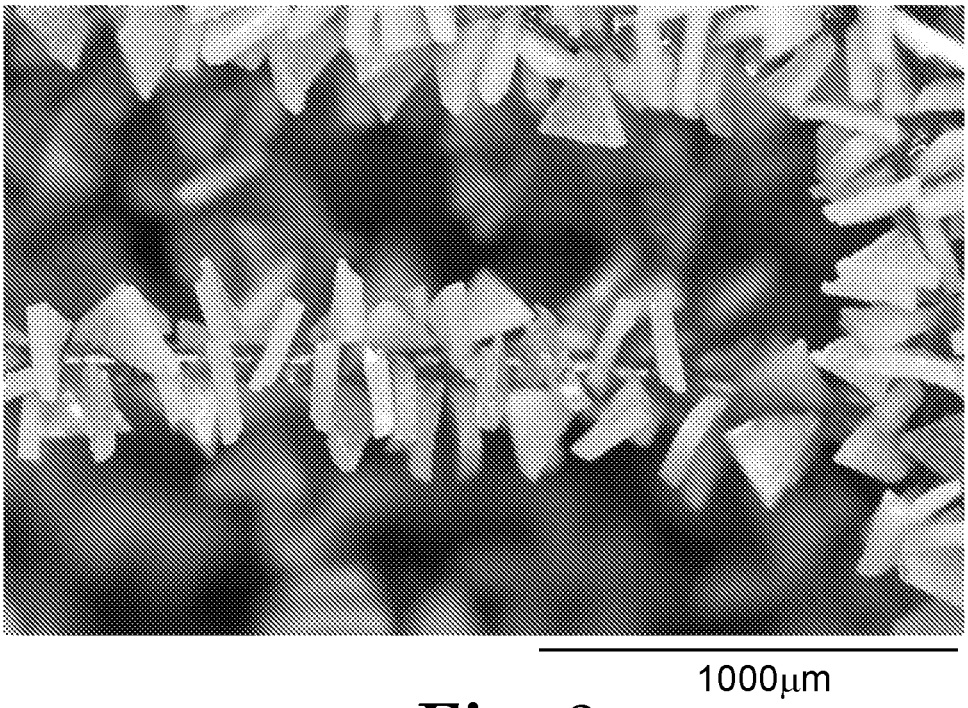
Figure 9:
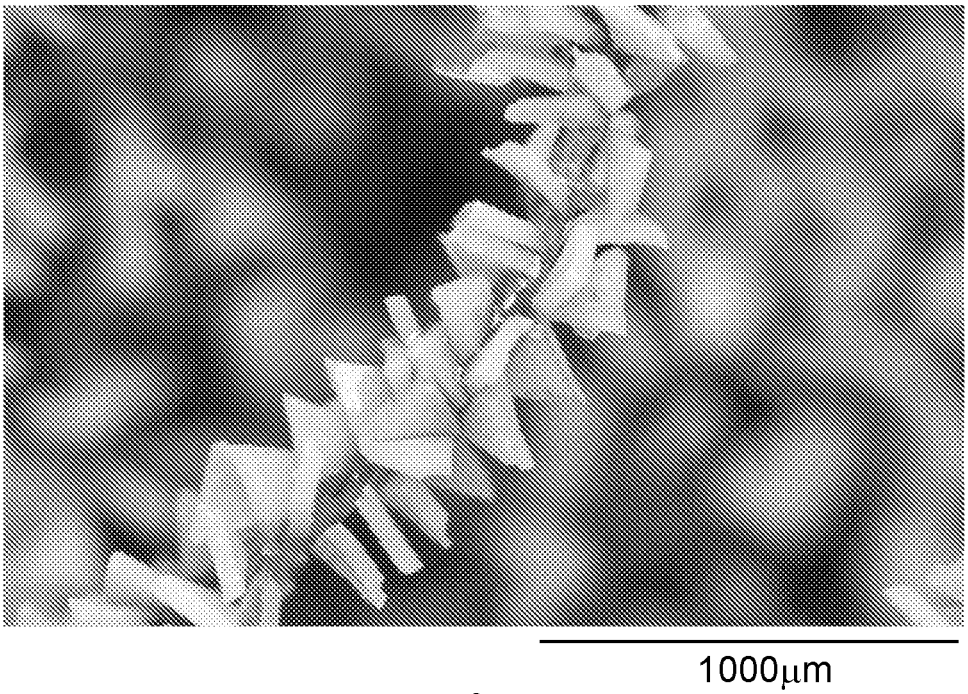
Figure 10:
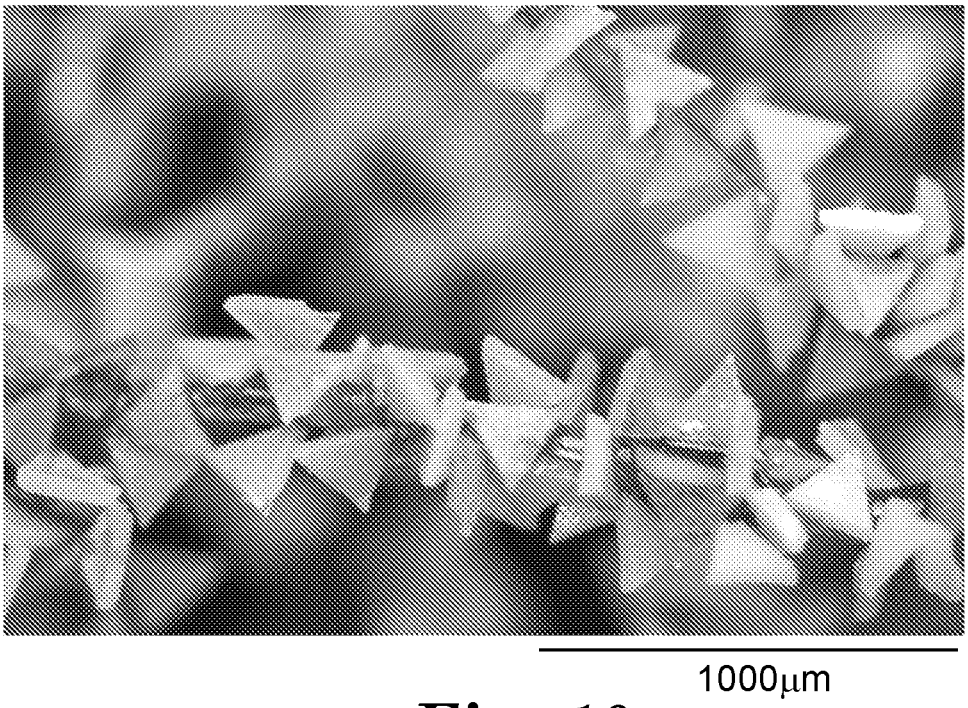
Figure 11:
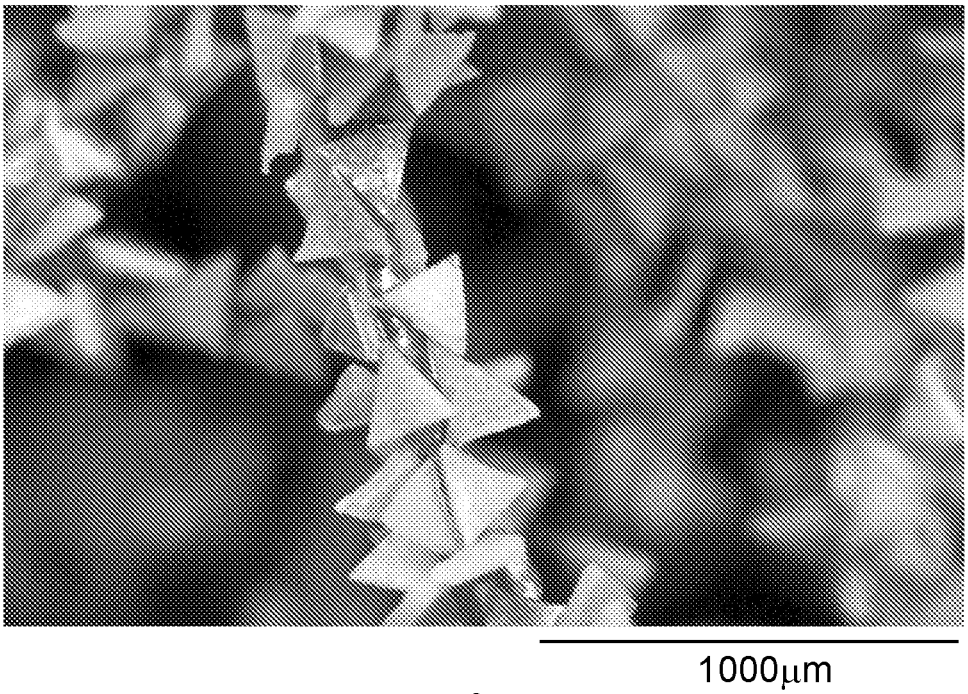
Figure 12:
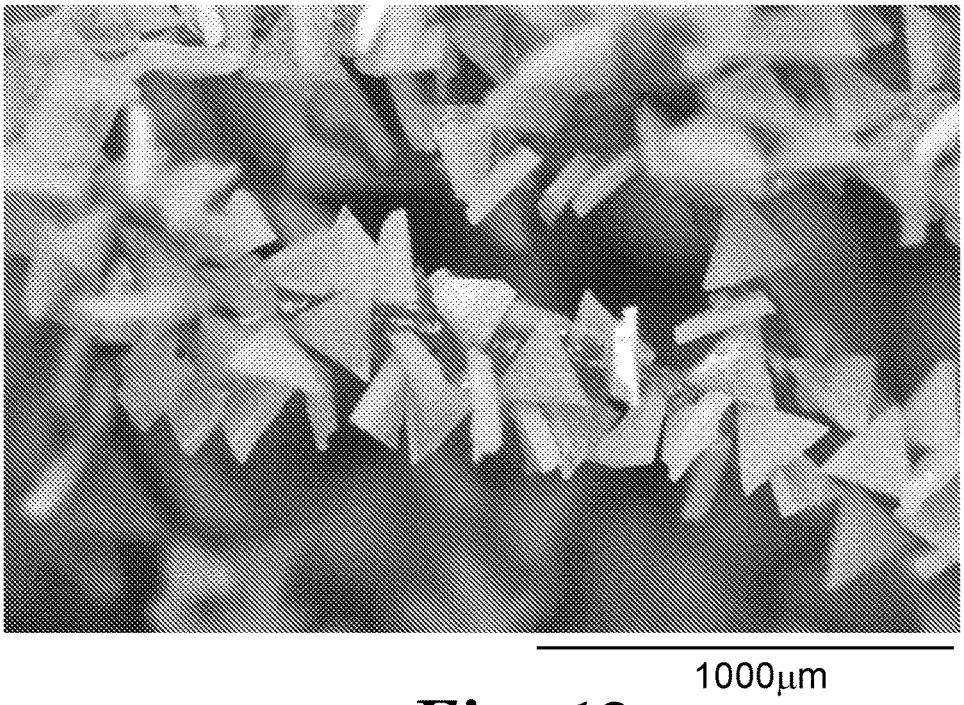
Figure 13:
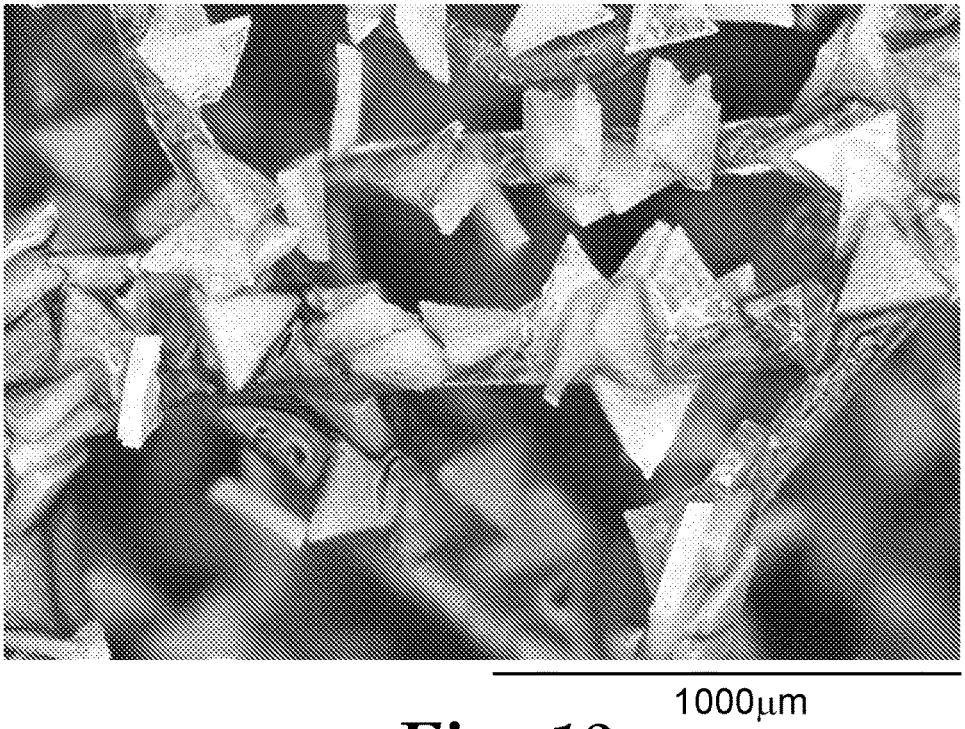
Figure 14:
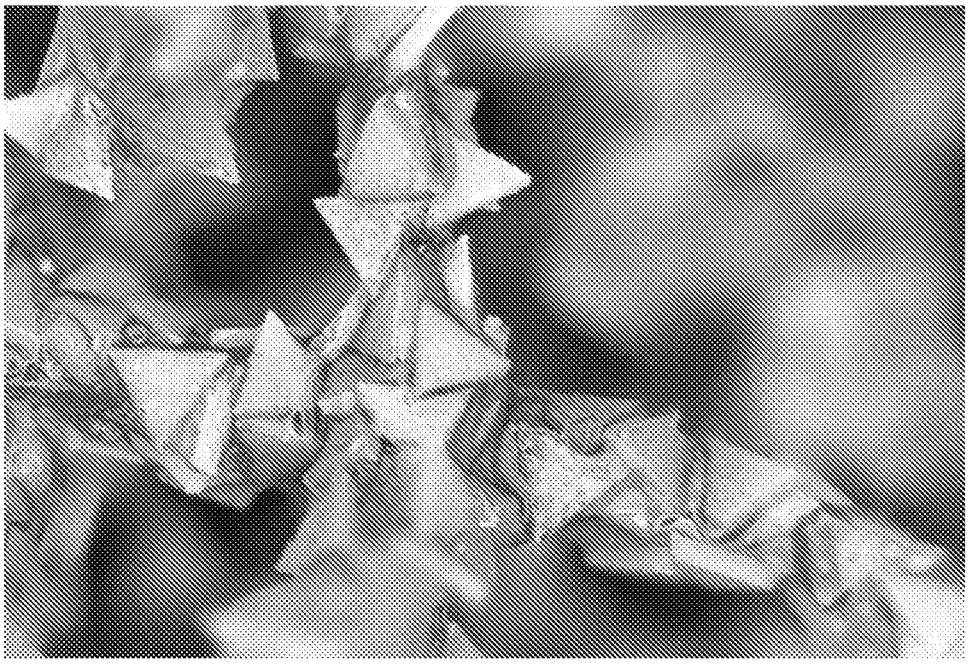
Figure 15:
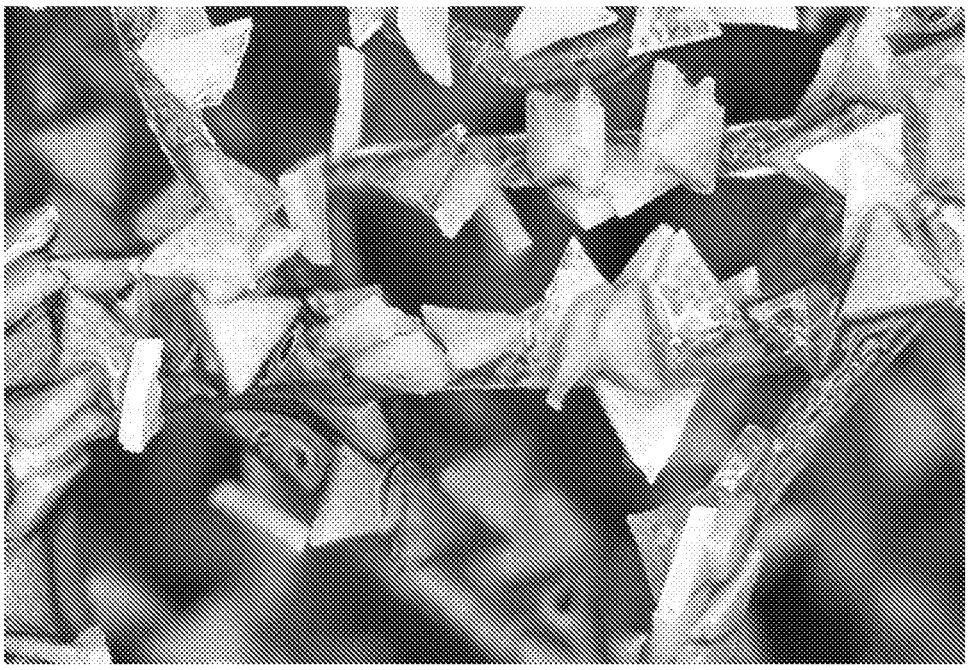

| EXAMPLE | REFERENCE FIG. | NUMBER OF PARTICLES STUDIED | PARTICLES RADIALLY-ORIENTED | % OF ABRASIVE PARTICLES RADIALLY-ORIENTED | GROUP AVERAGE, % |
|---|---|---|---|---|---|
| Comp. Ex. A-1 | FIG. 4 | 19 | 6 | 32 | 38.8 |
| Comp. Ex. A-2 | FIG. 5 | 22 | 7 | 32 | |
| Comp. Ex. A-3 | FIG. 6 | 26 | 13 | 50 | |
| 1a | FIG. 7 | 33 | 25 | 76 | 77.1 |
| 1b | FIG. 8 | 34 | 25 | 74 | |
| 1c | FIG. 9 | 38 | 31 | 82 | |
| 2a | FIG. 10 | 33 | 22 | 67 | 62.7 |
| 2b | FIG. 11 | 21 | 11 | 52 | |
| 2c | FIG. 12 | 29 | 19 | 66 | |
| Comp. Ex. B-1 | FIG. 13 | 38 | 20 | 53 | 36.4 |
| Comp. Ex. B-2 | FIG. 14 | 25 | 2 | 8 | |
| Comp Ex. B-3 | FIG. 15 | 36 | 14 | 39 | |

TABLE 3

| EXAMPLE | REFERENCE FIG. | AVERAGE RADIAL (GREEN CIRCLES) DISTANCE, micrometers | AVERAGE TANGENTIAL (RED SQUARES) DISTANCE, micrometers | FIVE PARTICLES IN PLANE RADIAL DISTANCE, micrometers | FIVE PARTICLES IN PLANE TANGENTIAL DISTANCE, micrometers |
|---|---|---|---|---|---|
| Comp. Ex. A-1 | FIG. 4 | 241 | 155 | 248 | 135 |
| Comp. Ex. A-2 | FIG. 5 | | | | |
| Comp. Ex. A-3 | FIG. 6 | | | | |
| 1a | FIG. 7 | 216 | 169 | 255 | 136 |
| 1b | FIG. 8 | | | | |
| 1c | FIG. 9 | | | | |
| 2a | FIG. 10 | 225 | 145 | 267 | 158 |
| 2b | FIG. 11 | | | | |
| 2c | FIG. 12 | | | | |
| Comp. Ex. B-1 | FIG. 13 | Not Measured | Not Measured | Not Measured | Not Measured |
| Comp. Ex. B-2 | FIG. 14 | | | | |
| Comp Ex. B-3 | FIG. 15 | | | | |

Comparative Example C and Examples 3-4

Abrasive Discs

A size coat consisting of 21.4 wt. % of PR, 13.2 wt. % of PME, 4.6 wt. % of CA, 2.5 wt. % of AL, 0.9 wt. % of BC and 57.4 wt. % of MIN was sprayed to achieve a wet add-on of 741 gsm (177 grains/24 sq. in.) on Comparative Example A and Examples 1 and 2, which were then cured at 163° C. for 15 minutes. The abrasive discs were identified as Comparative Example C and Examples 3 and 4 respectively. The resulting composite was evaluated by the Disc Abrasion Test. Two replicates were prepared. Test results are reported in Table 4, below.

TABLE 4

| EXAMPLE | DISC CUT, grams | DISC WEAR, % weight loss |
|---|---|---|
| Comp. Ex. C-1 | 6.00 | 2.34 |
| Comp. Ex. C-2 | 6.59 | 2.17 |
| 3a | 9.42 | 3.97 |
| 3b | 8.42 | 3.74 |
| 4a | 7.32 | 2.17 |
| 4b | 9.36 | 2.50 |

As shown in Tables 2 and 3, orientation of the particles with electrostatic coating was greater than drop coating comparing Comparative Example A and Example 1. Example 2 shows an amount of orientation between drop coating and electrostatic coating by applying half the particles by each method. Comparative Example B shows how the benefit of orientation percent can be affected by increasing the resin add-on level which allows the particles to fall over on the fiber due to a large amount of coating. Table 4 shows the corresponding disc cut performance on carbon steel. The increased orientation seen in Examples 3 and 4 over Comparative C translates to increased cut for the discs.

Examples 5-6 and Comparative Examples D-E

Unitized nonwoven abrasive wheels and convolute nonwoven abrasive wheels were made with and without the use of electrostatic spray. The dry spray mineral process uses only air to propel the abrasive particle onto the web. The electrostatic process also uses air to propel the abrasive but also imparts an electrical charge onto the particle via an electrode at the exit tip of the gun (obtained as EASY SELECT MANUAL POWDER GUN USING A GEMA VOLSTATIC CONTROL BOX from Gema USA, Inc., Indianapolis, Ind.).

Example 5 and Comparative Example D

The unitized abrasive wheel of Example 5 was prepared by spray coating a 119 g/m$^2$ 24 denier nylon fiber air laid nonwoven web with 30 g/m$^2$ (dry) of an acrylic/urethane binder consisting of 38.9 parts A1, 35.86 parts water, 21.51 parts WU, 3.07 parts A2, 0.39 parts Green, 0.26 parts Black, 0.0002 parts DF following by heating at 285 degrees Fahrenheit for 6 minutes. 174 g/m$^2$ (dry) of a make coating consisting of 57.8 parts PU1, 12.14 parts CUR, 2.89 parts ER1, 15.03 parts KBF4, 5.78 parts PMA, 2.89 parts LiSt, 2.31 parts SILICA, and 1.16 parts PEG was then applied by roll coating. 593 g/m$^2$ of SAP2 was then applied by electrostatic spray followed by heating at 300 degrees Fahrenheit for 5 minutes. 474 g/m2 (dry) of a size resin consisting of 55.59 parts PU2, 7.73 parts CUR, 2.78 parts ER1, 22.79 parts PMA, 3.34 parts LiSt, 1.95 parts SILICA, 1.11 parts PEG, 3.34 parts CaSt, 0.56 parts ER2, and 0.83 parts UVA was then applied by a roll coater. 8 layers of the resulting abrasive composition were stacked and placed into a mold and compressed to a thickness of 0.5 in (1.27 cm). The mold was placed into an oven at 240 degrees Fahrenheit for 6 hours, and after removal the resulting abrasive slab was cut to a 6 in (15.24 cm) diameter unitized wheel of final density 12 g/in$^3$ (0.74 g/cm$^3$).

Comparative Example D was made identically to Example 5 with the exception that the SAP2 was applied by air spray instead of electrostatic spray.

Example 6 and Comparative Example E

Example 6 was prepared identically to Example 5, with the exception that the abrasive web composition was converted into a convolute wheel by winding 432 inches (11 m) around a 1 in (2.54 cm) diameter phenolic core under sufficient tension to create a 6 in (15.24 cm) diameter wheel of final density 12 g/in$^3$ (0.74 g/cm$^3$).

Comparative Example E was prepared identically to Example 6 with the exception that the SAP2 was applied by air spray instead of electrostatic spray.

Performance was measured using the Wheel Abrasion Test described above. The test results are shown in Table 5. The resulting cut for Comparative Example D was 1.3× higher in cut for the 8 lb test 1.7× higher in cut for the 10 lb test vs. Example 5. The results for Example 6 was 1.6× higher in cut for the 8 lb test and 1.2× higher in cut for the 10 lb test vs. Comparative Example E. Photos showed the tip of the SAP2 in the unitized construction orientated to the stainless steel workpiece when applied using the dry mineral sprayer and the tip of the SAP2 for the convolute construction is oriented to the workpiece when applied with the electrostatic process.

TABLE 5

| | Particle | 8 lb test | | 10 lb test | |
|---|---|---|---|---|---|
| EXAMPLE | Coating Method | Cut, grams | Wear, grams | Cut, grams | Wear, grams |
| Comp. Ex. D | air spray | 21 | 2 | 36 | 5 |
| 5 | electrostatic | 16 | 1 | 21 | 1 |
| Comp. Ex. E | air spray | 11 | 1 | 27 | 3 |
| 6 | electrostatic | 18 | 1 | 33 | 3 |

All cited references, patents, and patent applications in the above application for letters patent are herein incorporated by reference in their entirety in a consistent manner. In the event of inconsistencies or contradictions between portions of the incorporated references and this application, the information in the preceding description shall control. The preceding description, given in order to enable one of ordinary skill in the art to practice the claimed disclosure, is not to be construed as limiting the scope of the disclosure, which is defined by the claims and all equivalents thereto.

What is claimed is:

1. A nonwoven abrasive article comprising:

a lofty open nonwoven fiber web comprising entangled fibers; and abrasive platelets secured to the entangled fibers by at least one binder material, wherein each of the abrasive platelets comprises a first face and a second face, wherein the first and second faces are substantially parallel to each other and separated by a third face, wherein a dimension of the third face corresponds to a thickness of the abrasive platelet;

wherein a majority of the abrasive platelets are each respectively bonded to at least one of the entangled fibers such that each of the majority of the abrasive platelets is bonded to one of the entangled fibers along the third face, respectively, wherein a majority of the abrasive platelets are arranged such that the first and second faces are orthogonal to the entangled fibers.

2. A nonwoven abrasive article according to claim 1, wherein the first face of the abrasive platelets is a triangle.

3. A nonwoven abrasive article according to claim 1, wherein the abrasive platelets are closely-packed along the lengths of the entangled fibers.

4. A nonwoven abrasive article according to claim 1, wherein the nonwoven abrasive article comprises: a hand pad; a floor pad; or a surface conditioning pad, disc, or belt.

5. A nonwoven abrasive article according to claim 1, wherein the abrasive platelets nominally have the same size and shape.

6. A nonwoven abrasive article according to claim 1, wherein the abrasive platelets comprise shaped abrasive platelets bounded by upper and lower surfaces and a plurality of sidewalls disposed therebetween, wherein one of the sidewalls is the third face.

7. A convolute nonwoven abrasive wheel comprising a spirally wound and compressed nonwoven abrasive article according to claim 1.

* * * * *